US005677506A

United States Patent [19]

Wallin

[11] Patent Number: 5,677,506

[45] Date of Patent: Oct. 14, 1997

[54] SUBMARINE EXTENDIBLE TURRET SYSTEM

[75] Inventor: C. Roger Wallin, Portsmouth, R.I.

[73] Assignee: The United States of America as represented by the Secretary of the Navy, Washington, D.C.

[21] Appl. No.: 774,800

[22] Filed: Dec. 30, 1996

[51] Int. Cl.[6] ..... F41A 23/00

[52] U.S. Cl. ..... 89/38; 89/37.06; 114/320

[58] Field of Search ..... 89/37.06, 38; 114/316, 114/320

[56] References Cited

U.S. PATENT DOCUMENTS

| | | | |
|---|---|---|---|
| 1,095,049 | 4/1914 | Völler | 89/38 |
| 1,296,688 | 3/1919 | Noah | 89/37.06 X |
| 1,309,483 | 7/1919 | Ludlow | 89/38 |
| 1,376,536 | 5/1921 | Gunn | 89/38 |
| 1,399,395 | 12/1921 | Moran | 89/38 |
| 1,542,969 | 6/1925 | Spear | 89/38 |

*Primary Examiner*—Michael J. Carone
*Assistant Examiner*—Matthew J. Lattig
*Attorney, Agent, or Firm*—Michael J. McGowan; Robert W. Gauthier; Prithvi C. Lall

[57] ABSTRACT

Disclosed is an armored, turret like module configured for axial extension from a stowed position within the hull of a submarine. The turret would mount one or more remote controlled guns, as well as communications devices and sensors to support short range engagement with surface or air contacts. A complete, gun based weapon system concept, including command and combat control elements within the submarine control room, is intended. Other useful applications of this extendible turret system are also disclosed. For example, by such means personnel may also be transferred from within the ship to the outside world, via the turret, while submerged.

20 Claims, 5 Drawing Sheets

SUBMARINE EXTENDIBLE TURRET SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to submarines and more particularly to ordnance for submarines.

(2) Brief Description of the Prior Art

World War II submarines were routinely outfitted with deck guns as well as torpedo tubes for offensive and defensive armament. At that time it was recognized that many surface targets were too small for practical engagement with torpedoes, and there were sometimes special operational circumstances that warranted the display or threat of potential force rather than the actual expenditure of explosive ordnance.

The changing and expanding role of the submarine for the post cold war naval forces has altered some of the characteristic. practices of modern submariners. An example is the deliberate use of submarines as vessels to "show the flag" by visits to foreign ports. It is no longer always mandatory to avoid admission of the existence of submarines in foreign waters. It is recognized that submarines have become integral elements of many naval battle groups. Therefore, there may be diplomatic as well as military circumstances affecting modern submarine operations, where the overt display of a submarine force, at sea as well as in port, is appropriate.

There are various governments with small ship navies that might inflict damage upon U.S. or allied surface naval forces. While the AntiSubmarine Warfare (ASW) assets of such small ship navies might not be significant, they could threaten high value surface units with weapons such as surface to surface torpedoes. A submarine, operating in consort with such high value forces, might find that a response to that threat using traditional submarine launched weapons is difficult where it is necessary to engage lightweight, maneuverable, surface vessels. Most dual purpose torpedoes were designed for destroying large displacement hull ships. Also, anti-ship missiles that are launched from submarines may be limited in effectiveness if a target is at close range.

Rules of engagement in modern military operations may also restrict the use of devastating force. For example, the use of highly destructive weapons in the interdiction of commercial vessels in a blockade situation might not be appropriate. The master of a defiant vessel might show little respect for a submarine armed with torpedoes and cruise missiles, even if he was aware of its presence. The tactical and economic expense associated with the use of a submarine launched torpedo or missile, against a low or medium threat surface target, could also be a non-trivial command consideration in present day maritime scenarios. At times it is unnecessary to completely destroy a target. Rather, it may be desirable to engage the hostile vessel in small arms fire or simply to fire warning shots to ward off possible encounters. Since such encounters may be at close range, it is further desirable that a small arms system provide an element of surprise and also be capable of remote operation so as not to endanger the operator.

SUMMARY OF THE INVENTION

Accordingly, it is a general purpose and object of the present invention to provide a modern weapon system which would improve the capability of submarines to operate in waters where the possibility of non-traditional targets and tactical circumstances exists. It is a further object to provide a useful and effective offensive weapon system for use against small, or high speed, surface craft. It is a still further object to provide a weapons system which can be exposed unexpectedly from beneath the sea surface. Another object of the present invention is to provide a submarine with the added capability of remotely controlled anti-personnel ordnance. Yet another object is to provide a weapon system having the option to fire controlled warning shots at a target rather than completely destroying the target. These and other objects are accomplished with the present invention by providing a submersible vessel with a remotely controlled small arms weapon system in an extendible turret.

The present invention is at times below referred to as a submarine extendible turret system (hereafter "SETS"). This invention comprises a submersible vessel having an exterior hull substantially completely enclosing an interior space in which there is a selectively closeable ordnance deployment opening in the exterior hull. A linearly extendible ordnance deployment means is axially aligned with the ordnance deployment opening and is selectively positionable in either a first position completely within the interior space or in a second position at least partially extended through the ordnance deployment opening. An ordnance means is positioned in relation to the ordnance deployment means such that said ordnance means is in the interior space when the ordnance deployment means is in its first position and is outside the exterior hull when the ordnance deployment means is in its second position. Sensor means are positioned at least partially outside the exterior hull for acquiring target information, and command and control means are positioned in the interior space for remotely operating the ordnance means. Also encompassed by the present invention is the case where the submersible vessel is contained within a ballistic missile submarine which has an exterior hull surrounding an interior space having a plurality of vertical missile tubes.

The present invention also includes a submersible vessel having an exterior hull enclosing an internal space wherein the improvement comprises means for conveying objects from said internal space to said surface of the body of water. In one preferred embodiment, these conveying means may be used to transport personnel to the surface.

The vessel of this invention preferably includes a cylindrical module less than seven feet in diameter, contained within a watertight vertical tube in the hull of the submarine. The tube is normally secured against sea pressure by a hatch at the top that can be opened to allow the module to be raised to a position above the submarine's hull envelope. The module is preferably supported from below by a telescoping hydraulic mechanism that projects and retracts it from within the tube. During surface operations, the turret can be exposed just above the submarine hull, to the extent comparable to that of a deck mounted gun. When submerged, the module can be extended further, to a height that will penetrate the ocean surface while the ship is held at periscope depth, and permit a gun or guns mounted on the module to be unmasked and brought to bear upon a nearby surface, or air contact. The module would preferably be unmanned. Aim and control of the gun or guns and the module is preferably entirely by remote control from within the submarine's control room. The module is functionally equivalent to an unmanned gun "mount" or "turret". It contains one or more projectile firing gun barrels, a magazine or ammunition and mechanisms for feeding the ammunition to the gun or guns as well as for turning and stabilizing the module in train and raising or lowering the gun or guns about their trunnions, in elevation. Such a module will hereafter be referred to as a "turret".

Preferably, the turret is generally a cylindrical module, in plan view, while in elevation and cross section view it may be closed at the top by a dome shaped envelope. The upper part of the module is configured to rotate in azimuth, with respect to the lower part of the module which is fixed to the supporting structure below. A water restricted port or penetration is provided in the face of the turret to expose the muzzle of each of its gun or guns. The turret also contains one or more targeting sensors that can be positioned remotely to track a target designated from higher order sensors within the submarine. One or more additional penetrations or sensor "windows" is provided on the turret surface to expose the sensor or sensors used to track the designated target of the system. The turret structure also preferably includes communications instrumentation e.g., antennas, loudspeakers, or flashing light semaphore for remote contact with targeted units and others. When deployed above the surface, the streamlined turret should present a very small visual and radar profile. The exposed turret would preferably be approximately the size of a medium ocean navigation buoy and would have a mostly smooth, rounded surface. However, it is proposed that the turret be lightly armored to protect its mechanisms from damage.

The system of the invention may also be retrofitted on an existing ballistic missile carrying submarine. Specifically, it is proposed that the missile launching tube of an SSB(N) 640 class submarine could be modified to contain and support the extendible turret on that type of ship. The missile tube would serve as the barbette in the SETS equipped vessel. A cylindrical space that is about 40 feet in height and 83 inches in diameter should provide ample room for containment of the retracted turret and its support mechanism.

An important feature of the SETS system is to be able to move something that is usually contained within the hull of a submarine to the outside and back again when it is no longer needed outboard. For example, the module intended to support the guns could instead be configured to transport personnel from within the submarine to the surface and vice versa. A transfer using the proposed concept would expose part of the submarine, i.e., the turret, for a short time during that process, but the convenience that could be realized by using a SETS turret as a personnel transfer chamber compared to other means might offer important advantages. Other payloads are possible candidates for transport using the SETS concept. For example, a SETS turret might be configured to mount an anti-missile defense system such as the PHALANX CIWS. A submarine with one or more anti-missile defense modules exposed above the surface could locate in a submerged position alongside an anchored high value surface vessel and provide increased missile defense resources to that vessel while remaining completely impervious to missile attack.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE PREFERRED EMBODIMENT

Figure 1:
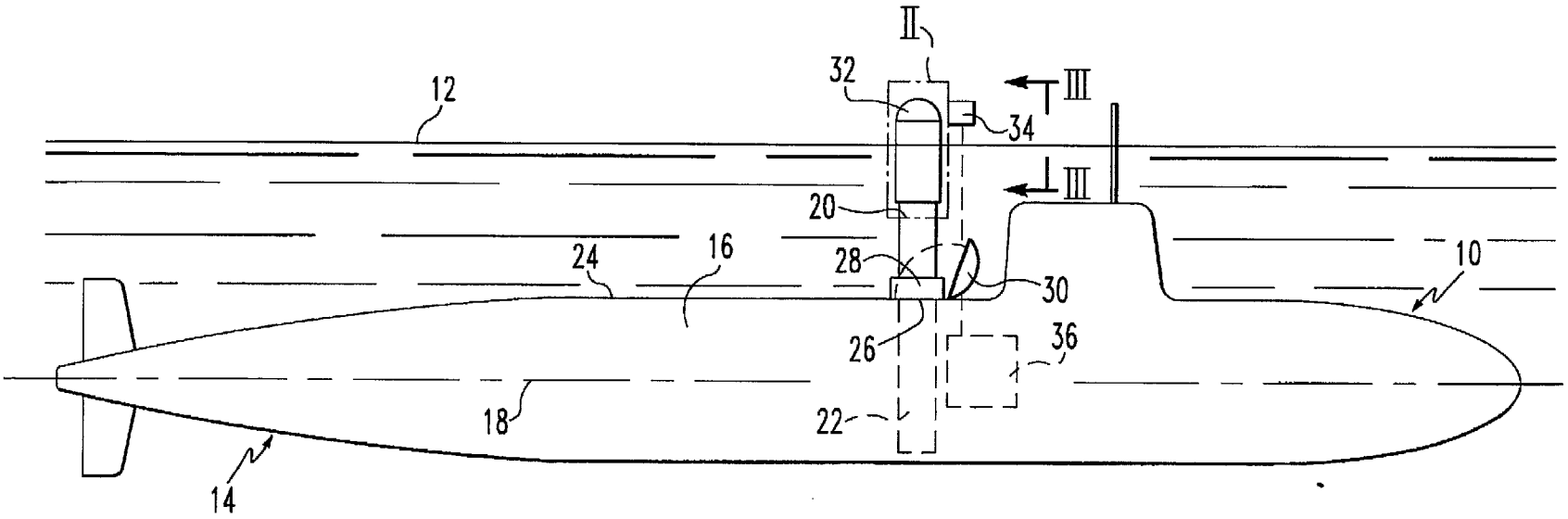
FIG. 1 is a schematic side view of a submarine representing a preferred embodiment of the present invention.

Referring to FIG. 1, a submarine which is shown at numeral 10 is positioned in a body of water beneath the ocean surface 12. As is conventional, this submarine has an exterior hull 14 which completely or substantially encloses an interior space 16. The submarine has a longitudinal axis 18 and perpendicular to this longitudinal axis is a linearly extendible telescopic support structure 20 which is mounted in a barbette 22. On the upper side 24 of the hull 14 there is a hull aperture 26 which is selectively closeable by a watertight barbette hatch 28 with hull door 30. Superimposed on the top of the telescoping support structure 20 there is a turret 32. When the telescopic support structure 20 is in its first lower position in the interior space 16 of the submarine, the turret 32 is also in the interior space of the submarine and under the closed hull door 30 and barbette hatch 28. When the telescopic support structure 20 is extended to its second upper position the turret 32 will be positioned adjacent and preferably slightly above the ocean surface 12 as is shown in FIG. 1. A sensor 34 is mounted on the turret. This sensor may be any conventional means for identifying a target or determining its direction, range or other information concerning it. Nonlimiting examples would be Electronic Support Measures (ESM), sonar, periscopes including photonics (remote periscope), instruments, radar and LIDAR (laser) target detection and tracking devices. In the interior space 16 of the submarine there is a command and control center 36 which is connected to the sensor 34 by any suitable conventional communications means. This command and control center includes a fire direction center which provides appropriate elevation and train instructions for the guns in the turret to engage a target based on range and direction information obtained from the sensors. Preferably the turret 32 will be unmanned and elevation and train settings will be remotely placed on the guns from the command and control center 36. The guns will also preferably be remotely fired from the command and control center 36.

Figure 2:
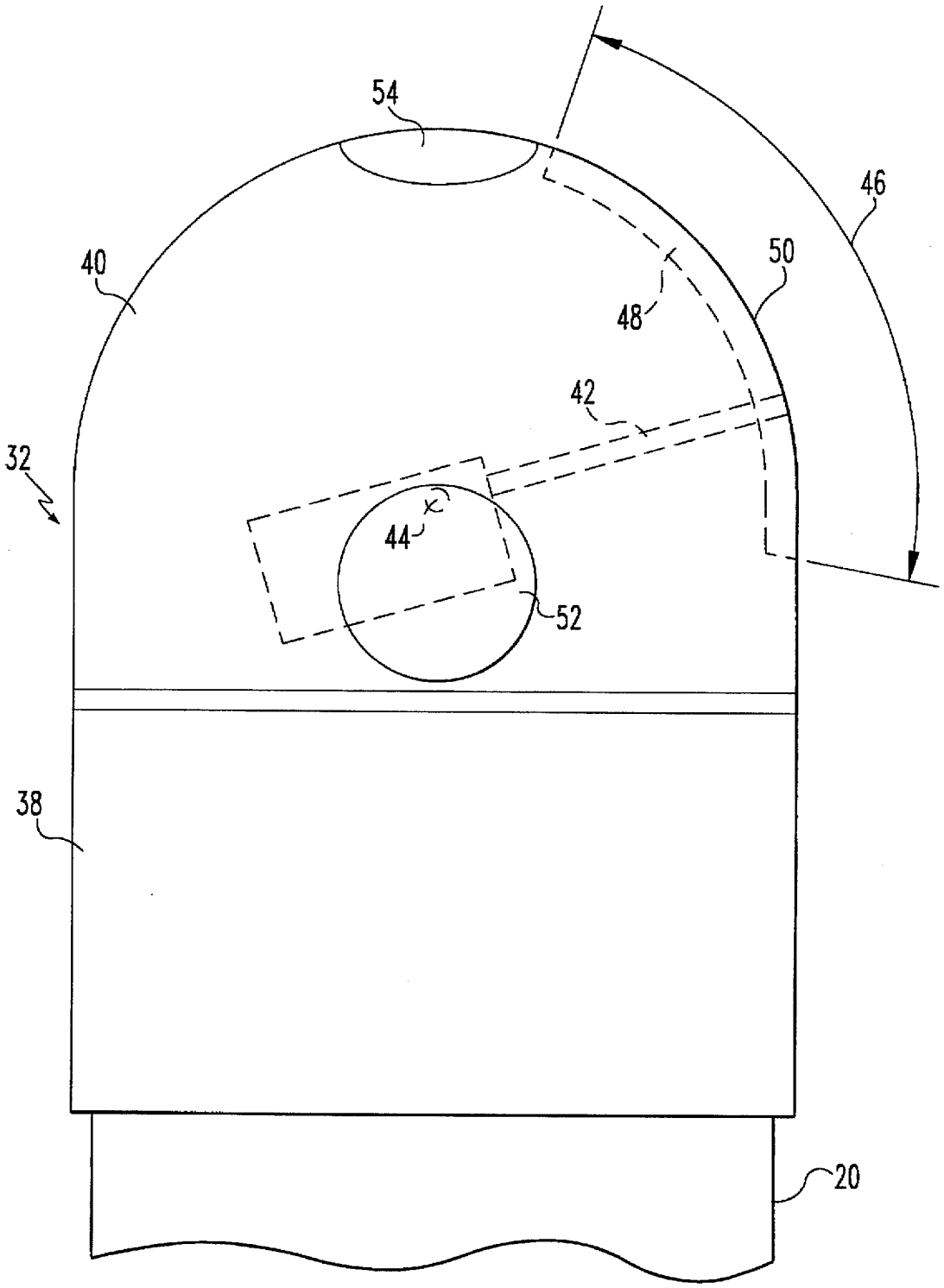
FIG. 2 is a detailed schematic view of the area within II in FIG. 1.

Referring to FIG. 2, it will be seen that the turret 32 includes a stationary section 38 and a rotating section 40 which pivots about the longitudinal axis of the turret to allow gun direction to be changed. A gun 42 is mounted on a trunnion 44 on which the gun pivots through gun elevation arc 46 to change elevation. The muzzle of gun 42 moves through recessed muzzle channel 48 to allow the gun to be fired through gun port 50. The turret also includes a gun access door 52 and a turret access hatch 54.

Figure 3:
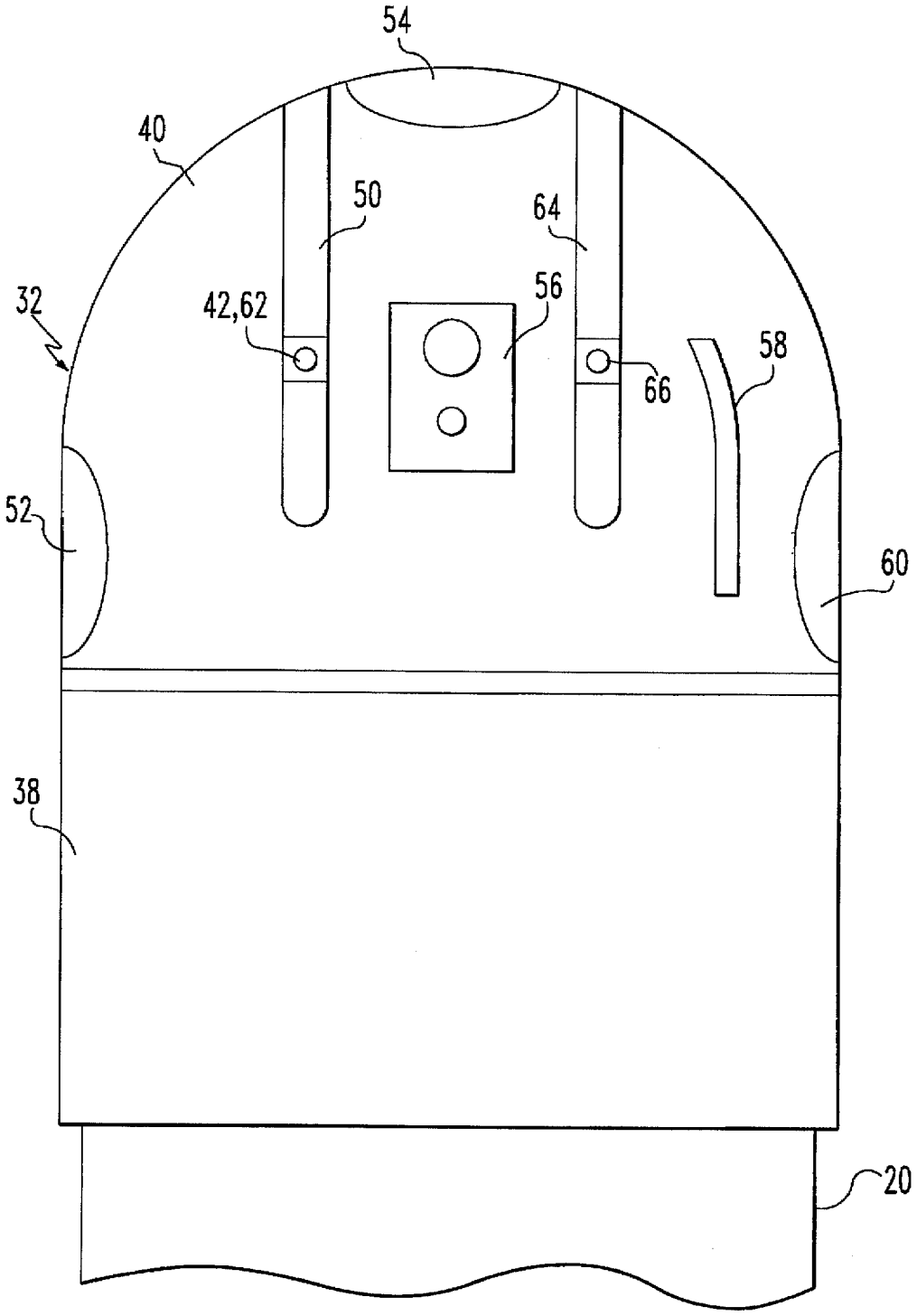
FIG. 3 is a detailed view from line III—III in FIG. 1.

Referring to FIG. 3, the turret 32 also includes a target sensor window 56 through which any conventional sensor may be employed. Other features include a surface mounted antenna 58, another gun access door 60, a muzzle 62 on gun 42, a second gun port 64 in which a second gun 66 is mounted.

Figure 4:
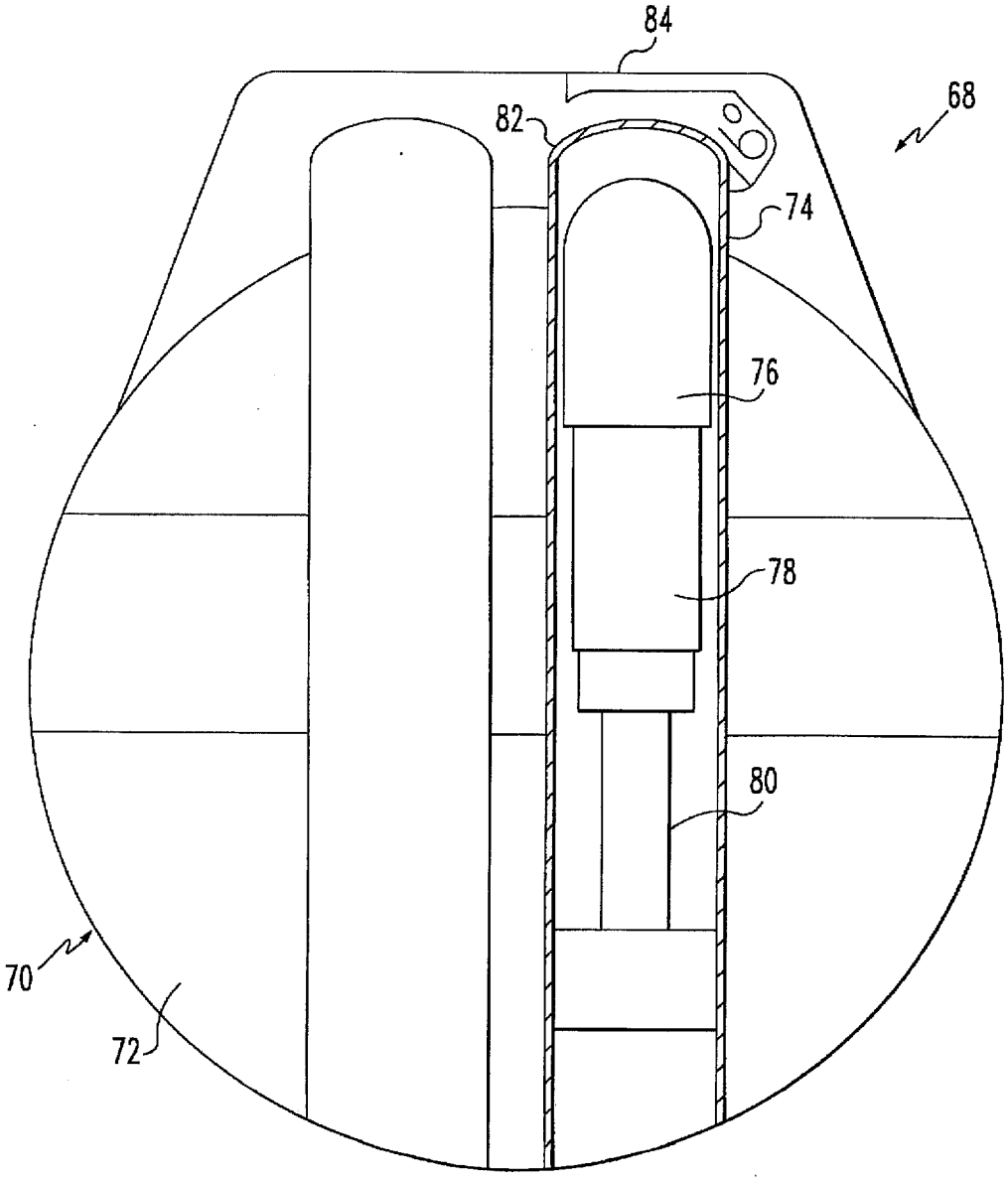
FIG. 4 is a transverse cross sectional view of a retrofitted ballistic submarine representing another preferred embodiment of the present invention.

Referring to FIG. 4, a ballistic missile submarine is shown at 68. This vessel has an exterior hull 70 which encloses an interior space 72. As is conventional, there are a plurality of missile tubes 74. Such a missile tube may be retrofitted, in accordance with the present invention, to include a turret 76. This turret would be positioned on a telescoping support structure 78 which would be moved from a lower first position in the interior space 72 as is shown in FIG. 4 by a hydraulic lift/retraction mechanism 80. As is conventional, there is a tube hatch 82 and a hull door 84. When this hatch and door open the hydraulic lift mechanism 80 would be able to move the telescoping support structure 78 to deploy the turret 76 to the ocean surface (not shown). Subsequently, the hydraulic lift/retraction mechanism 80 could also be employed to withdraw the telescoping support structure along with a turret 76 back into the missile tube 74.

Figure 5:
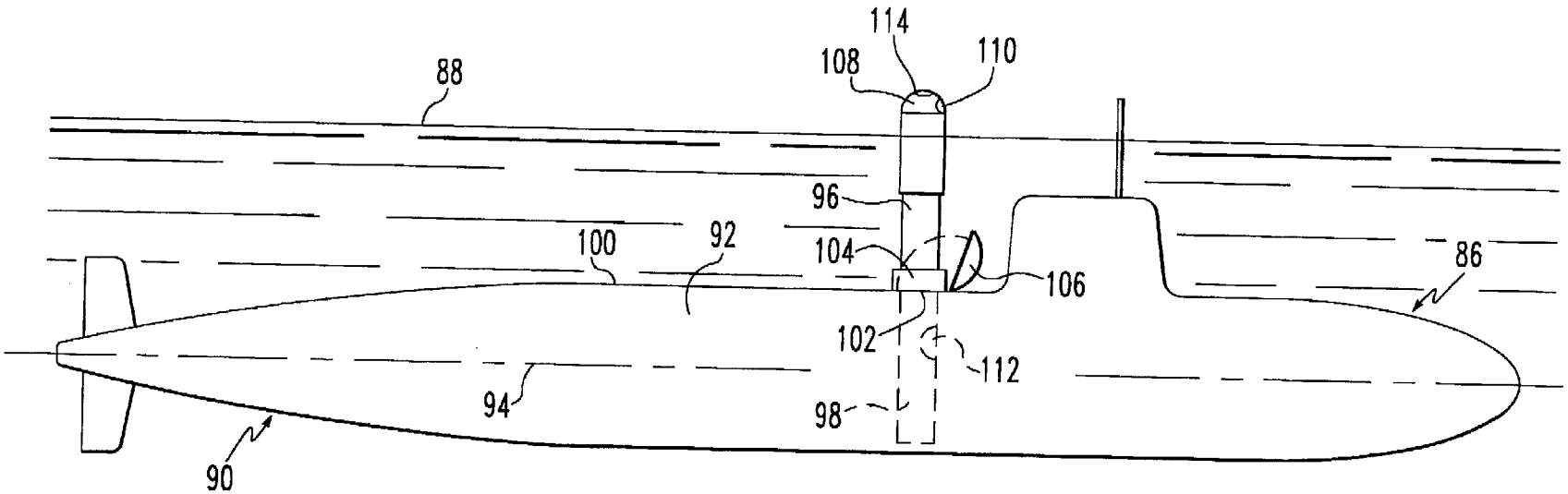
FIG. 5 is a schematic side view of a submarine representing a third preferred embodiment of the present invention.

Referring to FIG. 5, another preferred embodiment is shown in which a submarine 86 is positioned beneath the ocean surface 88. Its exterior hull 90 encloses interior space 92. The hull has a longitudinal axis 94 and a linearly extending telescoping support structure 96 positioned in support 98 in the interior space 92. On the upper side 100 of the hull there is a hull aperture 102 which is selectively closeable by a watertight support hatch 104 and a hull door 106. Mounted on the linearly extendible support structure 96 there is a personnel deployment housing 108. In this embodiment the laterally extendible support structure moves the personnel deployment housing 108 from its first lower position in the interior space 92 to a second deployed position adjacent the ocean surface 88 to allow personnel to move between the two positions via the personnel deployment housing 108. In the first lower position, personnel door 110 in deployment housing 108 is aligned with tube door 112 in the side of support tube 98 to permit personnel to pass between interior space 92 and deployment housing 108. In the second or extended position, personnel door 110 provides access for personnel to exit or enter deployment housing 108 from near ocean surface 88. Deployment housing 108 may also be provided with a separate personnel hatch 114 for deployment of personnel at ocean surface 88.

Those skilled in the art will appreciate that an important feature of the present invention is its capacity to provide a submarine with a source of measured force for operational situations that might require the availability of lethal ordnance, but which do not call for the large scale destructive force provided by traditional submarine weapons, e.g. torpedoes, missiles, or mines. The SETS concept would provide a submarine with unique anti-personnel and small ship anti-surface capabilities for situations that involve close encounter hostilities or the enforcement of maritime policy. A limited degree of short range anti-air capability, e.g., against helicopters would also be available. Submarine crew members would remain inboard and would not be exposed to the potential of hostile surface counterfire during such scenarios. It is contemplated that SETS might be deployed whenever a submarine, so equipped, is engaged in surface transit in waters that are not certain to be totally friendly. While on the surface, the turret would be extended just above the hull to a height comparable to that of a deck mounted gun. In that position, its exposure would serve to exert a deterrent influence upon individuals or forces who might be motivated to conduct harassing actions towards an American submarine. Prior to submerging, the turret would be retracted and enclosed. For a submerged submarine, the SETS capability would provide a means to reveal a naval presence, unexpectantly and for a limited time, whenever and wherever that presence might be desired. An important advantage to such a submarine is that it would have the option of intentionally exposing its potential power to conflicting maritime units, military or civilian and then disappearing from the scene. In operation, the submarine's commander would select a surface contact of interest by usual means, using traditional combat system sensors, e.g., ESM, sonar, or periscope, for detection and classification. The ship's combat control system, modified for SETS, would develop initial targeting transmissions to preposition the turret sensors as close to the contact as possible, upon exposure. The ship would be brought to periscope depth and maneuvered as appropriate for the tactical situation. The SETS operator, within the control room of the submarine, would then actuate the mechanisms that open the barbette hatch and extend the turret. As soon as the turret breaks the surface, its sensors would activate and seek the target. This procedure would be controlled or assisted by the SETS console operator who would. observe the control room displays of turret sensor information. In a maritime enforcement scenario, an effort might be made to communicate with a surface contact's crew while displaying the obvious force available to the submarine. The SETS console operator would have the option of attempting communication using several turret mounted communication devices. The turret System would contain control room to bridge radio antennas, flashing light semaphore signaling apparatus and possibly even loudspeaker provisions for extremely short range encounters. The submarine combat control system, modified for SETS capability would function as a typical gun fire control system, processing turret sensor data and transmitting orders for gun positioning. The SETS console operator would be able to monitor the aim of the guns visually and he would control firing of the weapons when required. When the tactical situation no longer required deployment of the gun weapon system, the SETS turret, or "gun tower" would be lowered into the barbette and the watertight hatch secured. The gun or guns magazine would be serviced internally through ports in the barbette.

It will be appreciated that an extendible turret with mounted guns or other type weapon launch mechanisms has been described. The turret may be controlled remotely in train and elevation and it is stabilized against ship motion by signals transmitted to turret motors from within the submarine.

Those skilled in the art will also appreciate that a computer based fire control and command/control sub-system to process sensor information and develop targeting and stabilization orders for transmission to the turret may be advantageously used to provide computer driven displays of tactical data required to direct an engagement using the turret mounted weapons. The fire control, command/control sub-system provides all man-machine interface requirements for the system., including remote actuation of the gun firing mechanism. A sensor sub-system comprised of a variety of sensors to detect and measure parameters regarding own ship status and target location may also be incorporated into the systems. Some sensor devices could be mounted on the extendible turret so that they can be exposed and remotely directed towards an intended target while the submarine is submerged. Compared to sensors that might be "floated" to the surface on a tethered buoy, sensors attached to the extendible turret have the advantage of remaining fixed to the parent ship, thereby retaining directional stability, while the submarine is submerged. Compared to separate extendible mast mounted devices, sensors that are integral with the weapon launcher will eliminate the problem of system parallax correction.

The opportunity facilitated by the extendible turret to utilize surface oriented target sensors is also available. By configuring the extendible turret as a mount for some of the system sensors, several advanced type sensors which require exposure above the surface can be considered for inclusion in the proposed submarine system. The extendible turret would support, photonics (remote periscope) instruments, radar antennae and LIDAR (laser) target detection and tracking devices.

The SETS would provide submarines with a unique new weapon capability that is responsive to the unusual limited warfare situations that characterize present day military operations. A submarine with the SETS would possess improved means to participate in all types of sea control and maritime enforcement operations and it would have the appropriate firepower to deal with a wide range of potential adversaries.

While the present invention has been described in connection with the preferred embodiments of the various elements, it is to be understood that other similar embodiments may be used or modifications and additions may be made to the present described embodiment for performing the same function of the present invention without deviating therefrom. Therefore, the present invention should not be limited to any single embodiment, but rather construed in breadth and scope in accordance with the recitation of the appended claims.

What is claimed is:

1. In a submersible vessel having an exterior hull substantially completely enclosing an interior space, wherein the improvement comprises:

a selectively closeable ordnance deployment opening in the exterior hull;

a linearly extendible ordnance deployment means axially aligned with the ordnance deployment opening and being selectively positionable in either a first position completely within the interior space or in a second position at least partially extended through the ordnance deployment opening;

an ordnance means positioned in relation to the ordnance deployment means such that said ordnance means is positioned in the interior space when the ordnance deployment means is in its first position and said ordnance means is positioned outside the exterior hull when the ordnance deployment means is in its second position;

sensor means positioned at least partially outside the exterior hull for acquiring target information; and command and control means positioned in the interior space for remotely operating the ordnance means.

2. The vessel of claim 1 wherein the ordnance means is a weapons launcher.

3. The vessel of claim 2 wherein the ordnance means is a gun.

4. The vessel of claim 2 wherein the weapons launcher is an anti-aircraft means.

5. The vessel of claim 2 wherein the weapons launcher is housed in a turret.

6. The vessel of claim 1 wherein the vessel is positioned in body of water having a surface and in the second position of the ordnance deployment means the ordnance means is adjacent said surface.

7. The vessel of claim 6 wherein the extendible ordnance deployment means is a telescoping support.

8. The vessel of claim 1 wherein the closeable ordnance deployment opening is equipped with a water tight hatch.

9. The vessel of claim 1 wherein the sensor means includes Electronic Support Measures (ESM).

10. The vessel of claim 1 wherein the sensor means includes sonar.

11. The vessel of claim 1 wherein the sensor means includes a remote periscope.

12. The vessel of claim 5 wherein the sensor means is at least partially located on the turret.

13. The vessel of claim 12 wherein the turret is controlled remotely in train and elevation and is stabilized against motion of the vessel by the command and control means.

14. The vessel of claim 13 wherein the command and control means remotely activates the weapons launcher.

15. The vessel of claim 14 wherein the sensor means detect and measure parameters regarding both the vessel itself and the target location.

16. In a ballistic missile submarine having an exterior hull surrounding an interior space having a plurality of vertical missile tubes each of said tubes having a selectably closeable missile deployment opening wherein the improvement comprises:

a linearly extendible ordnance deployment means axially aligned with the missile deployment opening and being selectively positionable in either a first position completely within the interior space or in a second position at least partially extended through the missile deployment opening; and an ordnance means positioned in relation to the ordnance deployment means such that said ordnance means is positioned in the interior space when the ordnance deployment means is in its first position and said ordnance means is positioned outside the exterior hull when the ordnance deployment means is in its second position.

17. The submarine of claim 16 which also includes:

sensor means positioned at least partially outside the exterior hull for acquiring target information; and command and control means positioned in the interior space for remotely operating the ordnance means.

18. In a submersible vessel having an exterior hull substantially completely enclosing an interior space, wherein the improvement comprises:

a selectively closeable personnel deployment opening in the exterior hull;

a linearly extendible personnel deployment means axially aligned with the personnel deployment opening and being selectively positionable in either a first position completely within the interior space or in a second position at least partially extended through the personnel deployment opening; and a personnel housing means superimposed on the ordnance deployment means such that said personnel housing means is positioned in the interior space when the personnel deployment means is in its first position and said personnel housing means is positioned outside the exterior hull when the personnel deployment means is in its second position.

19. The vessel of claim 1 wherein the ordnance deployment means is adapted to transport personnel.

20. The submarine of claim 16 wherein the ordnance deployment means is adapted to transport personnel.

* * * * *